US008104099B2

(12) United States Patent
Olmos Plaza

(10) Patent No.: US 8,104,099 B2
(45) Date of Patent: Jan. 31, 2012

(54) TRANSFORMABLE WOMENS' TROUSERS

(76) Inventor: Antonio Olmos Plaza, Sabadell (ES)

( * ) Notice: Subject to any disclaimer, the term of this patent is extended or adjusted under 35 U.S.C. 154(b) by 493 days.

(21) Appl. No.: 12/185,793

(22) Filed: Aug. 4, 2008

(65) Prior Publication Data

US 2009/0031477 A1 Feb. 5, 2009

(30) Foreign Application Priority Data

Aug. 2, 2007 (ES) ..... 200701723 U

(51) Int. Cl.
*A41D 1/14* (2006.01)
*A41D 13/02* (2006.01)

(52) U.S. Cl. ..... 2/211; 2/228; 2/69

(58) Field of Classification Search ..... 2/69, 227, 2/228, 238, 211, 212, 79, 105, 106, 243.1; 383/4

See application file for complete search history.

(56) References Cited

U.S. PATENT DOCUMENTS 1,784,369 A * 12/1930 Lowenbaum ..... 2/72
1,794,307 A * 2/1931 Lowenbaum, Jr. ..... 2/72
2,080,814 A * 5/1937 Foltz ..... 2/72
2,744,253 A * 5/1956 Freedman ..... 2/80
3,083,373 A * 4/1963 Rizzotto ..... 2/270
3,797,043 A * 3/1974 Brument ..... 2/69.5
4,104,742 A * 8/1978 Rahaim ..... 2/213
4,106,125 A * 8/1978 Palumbo ..... 2/213
4,190,908 A * 3/1980 Herskind ..... 2/213
4,215,435 A * 8/1980 Miele ..... 2/227
4,907,298 A * 3/1990 Lisowski ..... 2/212
5,628,064 A * 5/1997 Chung ..... 2/70

* cited by examiner

*Primary Examiner* — Gloria Hale
(74) *Attorney, Agent, or Firm* — Martin Faier; James Faier; Faier & Faier P.C.

(57) ABSTRACT

Transformable womens' trousers which, comprised of an upper part with means to fasten a belt around a user's waist, and having a zipper on its lower hem region with which to join other parts corresponding to the trouser legs, with side zippers that allow its extension in order to be joined in different combinations or in such a manner as to form a skirt, or even produce a handbag by joining specific parts, characterized in that the upper part has a peripheral zipper that corresponds to its lower hem region, to which a second bridge part is joined to comprise the upper part of the trouser legs, said zipper being disposed above the crotch of said bridge part or piece so as to comprise, through the separation thereof, a mini-skirt.

7 Claims, 2 Drawing Sheets

TRANSFORMABLE WOMENS' TROUSERS

PRIORITY CLAIM

This application is presented pursuant to 35 U.S.C. Section 119 and claims priority from Spanish Utility Application Number U 200701723 filed 2 Aug. 2007.

OBJECT OF THE INVENTION

The present invention relates to transformable womens' trousers, the obvious purpose of which is to allow their transformation into different types of trousers and, particularly, to convert the trousers into a mini-skirt and to skirts of different lengths. The object of the invention is to allow a garment purchased as trousers to be transformed, thus obtaining different types of garments in accordance with the user's preferences and desires and, although these trousers are preferably and fundamentally envisioned to be used by women. The inventor does not dismiss the possible use as unisex trousers by both men and women. Different trousers can be produced by varying the parts. Different types of trousers from a mini-skirt to skirts of different lengths can be produced.

BACKGROUND OF THE INVENTION

Spanish Utility Model U 9803245 discloses a pair of trousers that can be converted into shorts, long trousers of different lengths and formats, a skirt of longer or shorter length, and even a handbag, by combining the separable parts that comprise the original trousers.

Specifically, the trousers defined in Utility Model 9803245 basically consists of an upper part with a separable belt, that comprises a pair of shorts, in such a manner that the lower hem region of said upper part or shorts is joined, by means of a zipper, to a second part that comprises the upper part of the trouser legs, said upper part of the trouser legs being joined to longer parts that correspond to the actual trouser legs, that are fastened laterally by means of zippers, whereas below and as an extension of said legs, the trousers consist of other parts, joined together and joined laterally by means of zippers, that complete the total length of the trousers, complemented by lower parts identically joined together by means of zippers, comprising the so-called hems, that lack side zippers in order to enable said parts to be cut so as to adapt the trousers according to the user's height and/or other goals.

All of the aforementioned parts or pieces can be of any nature, preferably from elastic fabric to a combination of cloths or materials of different colors, adornments and a greater or lesser number of pockets, in both the upper part corresponding to the shorts and in the legs and other parts that comprise the trousers.

All of these parts can be separated and joined together in different combinations to produce the aforementioned shorts, trousers of different lengths and formats, skirts and even a handbag that can be produced by extending and joining the different parts of the longer leg parts, using the complementary belt as the handbag strap.

The drawback of the transformable trousers corresponding to Utility Model 9803245 is that their constituent element is a pair of shorts, in such a manner that, when these are converted into a skirt, then the upper part shall always be comprised of said shorts, due to the fact that the zipper that joins that upper part of the trousers to the rest of the parts is disposed below the crotch, so that when it is transformed into a skirt a part of the trousers always remains, which is precisely that upper part above the zipper, tucked underneath the skirt produced through the adequate combination of the other parts, which is uncomfortable for the user.

DESCRIPTION OF THE INVENTION

The trousers of the invention, based on those described in the previous section, have a series of peculiarities that resolve the problem identified above. The main and primary characteristic of the new trousers is that they can be converted into a mini-skirt comprised by the upper part of said trousers, as the zipper, rather than being conventionally disposed underneath the crotch, is disposed above said crotch, in such a manner that on separating the lower parts or pieces of the trousers, the aforementioned upper part becomes a mini-skirt to which other parts can be added to comprise skirts of different lengths.

The new trousers have a second characteristic that consists of the fact that a second part or piece corresponding to the upper part of the trouser legs are joined above the crotch by the aforementioned upper zipper, in such a manner that this bridge part or piece must be joined to said zipper in order to produce trousers, the rest of the parts being joined to the lower hem region of the upper part of the trouser legs until a desired length is obtained, while to produce a skirt of any length said upper or bridge part of the zipper must be separated and not used, so that an actual skirt is produced without shorts, thereby increasing the comfort for the user.

Another novel characteristic of the trousers of the invention is that the upper part that comprises the mini-skirt, followed by the upper part of the trouser legs and the rest of the trousers or actual trouser leg parts, must be approximately straight in order to achieve their corresponding transformation into skirts of adequate width.

Similarly, the transformation of the trousers of the invention into a handbag is carried out in the same manner as that disclosed in the aforementioned Utility Model 9803245, with the peculiarity that in this case the separable trouser parts shall be about quadrangular and about straight, so as to produce a handbag with the adequate configuration, to which the ends of the belt can even be directly fastened to the zipper guide holes, thereby avoiding the need for the lower hems of the trousers of Utility Model 9803245. Obviously, in the handbag transformation, the use of longer or shorter trouser leg parts allow the composition of more or less spacious bags, whereby it is even possible to produce a large sport or travel bag by extending and joining all the trouser parts.

DESCRIPTION OF THE DRAWINGS

For the purpose of complementing the description below and to further explain the characteristics of the invention, a set of drawings in accordance with a preferred embodiment thereof has been included as an integral part of said description, in which the following figures have been represented in an illustrative manner.

PREFERRED EMBODIMENT OF THE INVENTION

Figure 3:
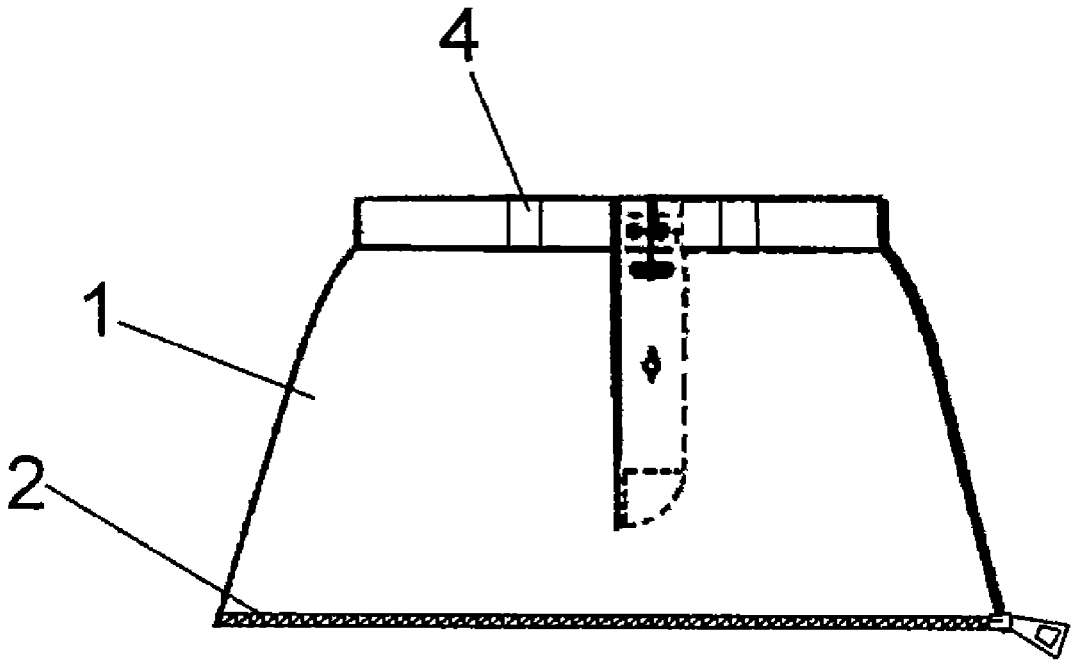
FIG. 3 shows a perspective view of the mini-skirt produced from the upper part of the trousers represented in FIGS. 1 and 2, by eliminating or separating the upper or bridge part of the trouser legs.

As shown in the aforementioned figures, the trousers of the invention are comprised of an upper part (1) which, by means of a zipper (2), is joined to a bridge part or piece (3) that comprises the upper part of the trouser legs, whereupon the zipper (2) is disposed horizontally and above the trouser crotch. That is, the upper part or piece (1) is tubular, along the upper hem of which belt loops (4) have been disposed for a belt, while the lower hem includes the zipper (2) by means of which the bridge part (3) of the upper of the trouser legs is joined, in such a manner that said zipper (2) peripherally encircles the trousers or, in other words, the perimeter of the upper part (1) after being separated from the bridge part (3), so as to produce trousers of different lengths and the mini skirt represented in FIG. 3.

Figure 1:
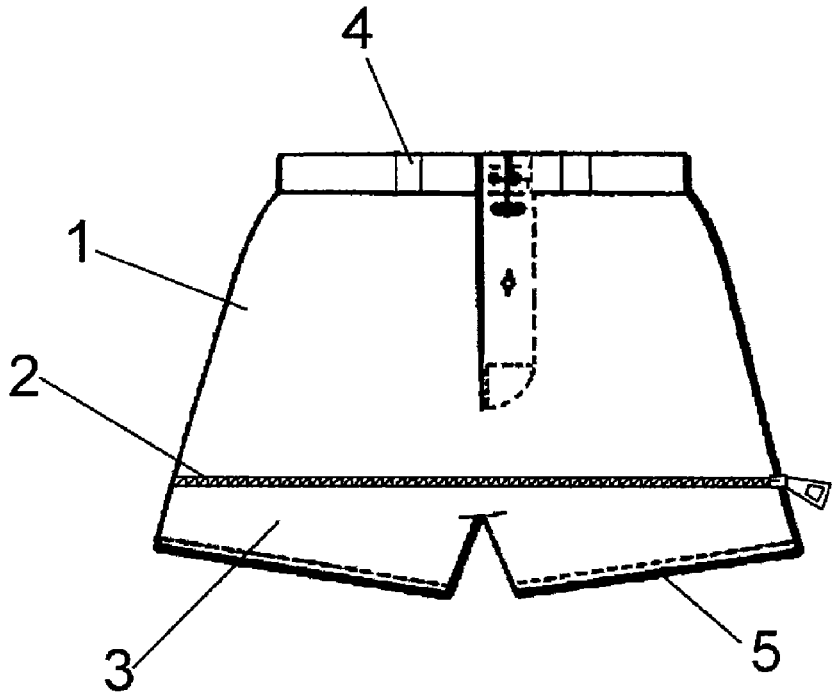
FIG. 1 shows a perspective front view of the transformable trousers of the invention, including the upper part thereof and the upper or bridge part of the trouser legs.
Figure 2:
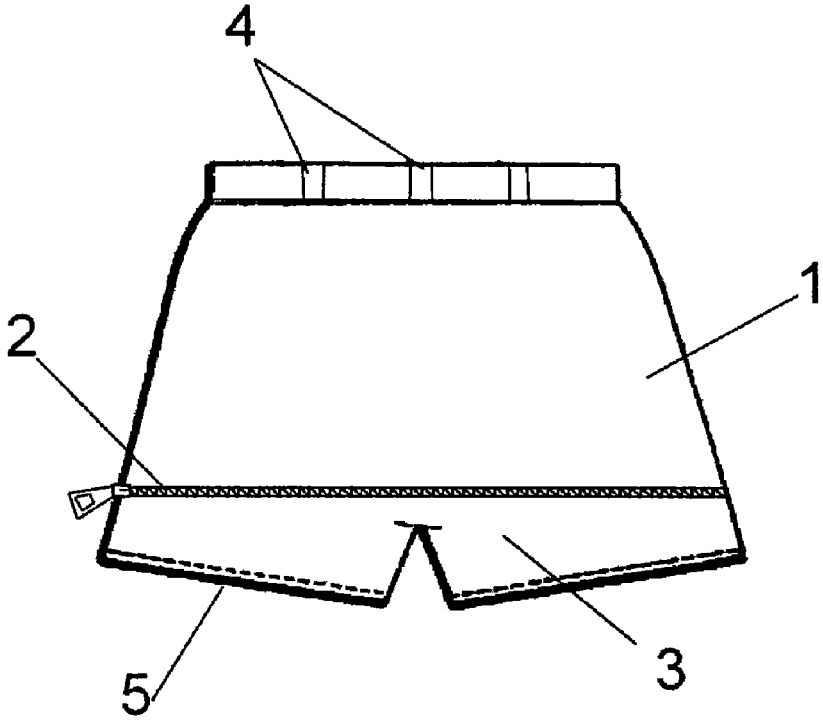
FIG. 2 also shows a perspective front view, in this case of the rear part of the trousers represented in the previous figures.

Trousers can be produced based on the representations shown in FIGS. 1 and 2, i.e. the upper part (1) and the bridge part (3), by adding other parts of different lengths to the lower hem region (5) of said bridge part (3), so as to produce longer or shorter trousers, i.e. shorts, ¾ length trousers, long trousers, etc., in such a manner that in all cases the parts or pieces (1 and 3) and other parts that comprise said trousers shall be about straight.

In order to produce skirts from the upper part (1), upon separation from the bridge part (3), the parts corresponding to the trouser legs shall be fastened to the zipper (2), extended and joined together, in such a manner as to form straight skirts of different lengths, depending on the number or length of the parts fastened to the zipper (2) of the upper part (1).

That is, in order to produce trousers, the bridge part (3) must be joined to the upper part (1), while in order to produce skirts, the bridge part (3) must be removed and the different extended parts corresponding to the trouser legs must be fastened above the zipper (2), as all of these parts have side zippers and, when extended, produce about straight parts which, when joined together at the front and back, comprise a skirt, upon being joined to the upper part or piece (1) by means of the zipper (2). The connecting devices, first and second portions of zipper 2, are complementary.

Inventor emphasizes that the different trouser and skirt parts may be of different nature (textile, leather, etc.) and may form different combinations, in addition to adding the different pocket parts using fasteners such as zippers, buttons, etc.

With regard to the handbag that can be produced from the previously described trousers, the user has only to extend determined trouser leg parts and join them together, said parts being about quadrangular so as to produce an adequately shaped handbag, in such a manner that, by using specific parts, the user may vary the size of the handbag and even join all the parts together to produce, once extended, larger bags, always using the belt that is fastened to the upper part (1) of the original trousers, once separated.

The invention claimed is:

1. A transformable garment conforming to the human torso, said garment having a waist area, a crotch area, and leg areas, said garment comprising an upper part, said upper part being a tubular portion with a waist area and a lower circumferential edge or end, said upper part being adapted to encircle said torso along said waist area and end in a circumferential edge, a first connecting device secured to said upper part end, a bridge part including a crotch area and leg areas that extend therefrom, said bridge part having an upper circumferential upper edge with a with a second connecting device thereon, said first and second connecting devices being complementary of each other and connected to each other to define a garment having leg areas when they are connected, and to define a miniskirt when they are not connected.

2. The garment recited in claim 1, wherein said garment having leg areas defines shorts when said first and second connecting device are connected.

3. The garment recited in claim 1 having leg portions, wherein said leg portions are removably secured to said bridge part by said second connecting device.

4. The garment recited in claim 1, wherein said second connecting device encircles said leg areas.

5. The garment recited in claim 1, wherein said first connecting device encircles said torso.

6. The garment recited in claim 1, wherein said first connecting device are complementary zipper portions.

7. The garment recited in claim 1, wherein said second connecting are complementary zipper portions.

* * * * *